US009976267B2

(12) United States Patent
Steiner

(10) Patent No.: US 9,976,267 B2
(45) Date of Patent: May 22, 2018

(54) SIDEWALK DROP SPREADER FOR WINTER SERVICES

(71) Applicant: Venture Products, Inc., Orrville, OH (US)

(72) Inventor: Roy I. Steiner, Dalton, OH (US)

(73) Assignee: Venture Products, Inc., Orrville, OH (US)

( * ) Notice: Subject to any disclaimer, the term of this patent is extended or adjusted under 35 U.S.C. 154(b) by 124 days.

(21) Appl. No.: 14/945,614

(22) Filed: Nov. 19, 2015

(65) Prior Publication Data

US 2016/0145821 A1 May 26, 2016

Related U.S. Application Data

(60) Provisional application No. 62/082,756, filed on Nov. 21, 2014.

(51) Int. Cl.

| | |
|---|---|
| ***A45D 24/22*** | (2006.01) |
| ***B65D 83/00*** | (2006.01) |
| ***B65D 88/66*** | (2006.01) |
| ***E01H 10/00*** | (2006.01) |

(52) U.S. Cl.
CPC ..... *E01H 10/007* (2013.01)

(58) Field of Classification Search
CPC ..... E01H 10/007; B65D 88/66; B65D 88/665
USPC ..... 222/196, 203; 239/650–689; 111/100–117
See application file for complete search history.

(56) References Cited

U.S. PATENT DOCUMENTS

| | | | | | |
|---|---|---|---|---|---|
| 2,865,536 | A | * | 12/1958 | Price | A01C 15/16 222/414 |
| 3,065,556 | A | | 11/1962 | Kampert | |
| 3,550,866 | A | | 12/1970 | Swenson | |
| 3,703,260 | A | | 11/1972 | Grabske | |
| 3,776,431 | A | | 12/1973 | Riley | |
| 4,002,272 | A | * | 1/1977 | Crawford | A01C 3/066 222/262 |
| 4,029,237 | A | | 6/1977 | Miconi | |
| 4,373,668 | A | | 2/1983 | Forbes et al. | |
| 4,449,648 | A | | 5/1984 | Gustaysson | |
| 4,523,280 | A | | 6/1985 | Bachman | |
| 4,588,113 | A | | 5/1986 | Egerdahl | |
| 4,712,717 | A | | 12/1987 | Egerdahl | |
| 4,798,325 | A | * | 1/1989 | Block | A01M 11/00 239/156 |

(Continued)

FOREIGN PATENT DOCUMENTS

EP 1106736 A2 6/2001

*Primary Examiner* — Jeremy W Carroll
(74) *Attorney, Agent, or Firm* — Dureska & Moore, LLC; David J. Danko

(57) ABSTRACT

The invention is directed to a sidewalk drop spreader for winter services, which is mountable on a vehicle and includes a hopper. The hopper includes a pair of spaced-apart side walls, each one of which extends parallel to the other one of the side walls, a front wall extending between the side walls, and a rear wall extending between the side walls and being spaced apart from the front wall. The hopper also includes a bottom, which in turn includes a rotatable rotor and a compression roller that extend parallel to one another between said the side walls. An agitation system includes a motor mounted to the hopper, which actuates movement of a selected one of the side walls, front wall, and rear wall.

20 Claims, 11 Drawing Sheets

(56) References Cited

U.S. PATENT DOCUMENTS

| | | | | |
|---|---|---|---|---|
| 4,938,650 | A | 7/1990 | Jenkins et al. | |
| 5,287,999 | A | 2/1994 | Olsen | |
| 5,524,368 | A | 6/1996 | Struck et al. | |
| 5,671,891 | A * | 9/1997 | Keenan | A01C 3/063 239/676 |
| 5,802,994 | A * | 9/1998 | Kinkead | A01C 7/008 111/11 |
| 5,813,613 | A * | 9/1998 | Keenan | A01C 3/063 239/676 |
| 5,950,934 | A | 9/1999 | Podesta et al. | |
| 6,220,532 | B1 | 4/2001 | Manon et al. | |
| 6,517,281 | B1 | 2/2003 | Rissi | |
| 6,702,208 | B1 | 3/2004 | Hadler et al. | |
| RE38,665 | E | 12/2004 | Struck et al. | |
| 6,932,286 | B2 | 8/2005 | Smith et al. | |
| 7,066,413 | B2 | 6/2006 | Musso et al. | |
| 8,185,276 | B2 | 5/2012 | Buckbee et al. | |
| 8,505,837 | B2 | 8/2013 | Warchola | |
| 8,523,086 | B2 * | 9/2013 | Warchola | E01C 19/203 239/677 |
| 8,695,238 | B2 | 4/2014 | Warchola et al. | |
| 2004/0124260 | A1 * | 7/2004 | Ward | E01H 10/007 239/146 |
| 2005/0189444 | A1 * | 9/2005 | Kost | E01C 19/20 239/661 |
| 2006/0006256 | A1 | 1/2006 | Smith et al. | |
| 2006/0049287 | A1 * | 3/2006 | Holverson | E01C 19/2045 239/657 |
| 2010/0164202 | A1 | 7/2010 | Dilworth et al. | |
| 2011/0017847 | A1 * | 1/2011 | Truan | A01C 17/001 239/661 |
| 2011/0068129 | A1 * | 3/2011 | Maurer | A47K 10/34 222/192 |
| 2011/0186649 | A1 * | 8/2011 | Richardson | E01H 10/007 239/146 |
| 2012/0234934 | A1 | 9/2012 | Score et al. | |
| 2013/0233937 | A1 | 9/2013 | Norkus et al. | |
| 2013/0233938 | A1 | 9/2013 | Norkus et al. | |
| 2014/0246362 | A1 * | 9/2014 | Biss | B65D 88/60 209/346 |

* cited by examiner

SIDEWALK DROP SPREADER FOR WINTER SERVICES

CROSS-REFERENCE TO RELATED APPLICATIONS

This application claims the benefit of U.S. Provisional Patent Application Ser. No. 62/082,756, which was filed on Nov. 21, 2014.

BACKGROUND OF THE INVENTION

Technical Field

The invention relates to a granular material spreader, and in particular to a drop spreader apparatus. More particularly, the invention is directed to a sidewalk drop spreader for winter services, which can be mounted on most all-terrain vehicles (ATVs), utility-terrain vehicles (UTVs), and compact tractors. The sidewalk drop spreader is capable of spreading an array of deicing materials with precision flow control, includes a narrow frame design that makes it ideal for spreading material on sidewalks and other narrow walkways, and includes an innovative agitation system that prevents material bridging and eliminates the need for a traditional, noisy vibration motor.

Background Art

There are two principal types of granular material spreaders in the art, broadcast spreaders and drop spreaders. These spreaders commonly spread materials such as seed, fertilizer, salt, sand, or other dry material.

Broadcast spreaders are comprised of a rotating member that centrifugally disperses the granular material from the spreader. The amount and concentration of the granular material being dispersed is controlled by adjusting the flow or amount of material being delivered to the rotating member and/or adjusting the speed of the rotating member.

However, broadcast spreaders may have issues with reliability. Material flow rate is often regulated with a "gate" that is controlled by a cable. Cables are susceptible to corrosion, resulting in machines that must be continuously maintained to ensure that the cables are in working order. In addition, broadcast spreaders struggle to provide precision control over the material spread rate, which undesirably results in wasted material and wasted cost.

Due to their nature of centrifugally dispersing and thus throwing material outwardly from a central point, broadcast spreaders also have issues with maintaining a consistent spread rate and a uniform spread width or pattern. Because broadcast spreaders do not control the spread width or pattern accurately enough, uncontrolled or uneven spread of material occurs. When the broadcast spreader is used for winter services, such as to spread deicing materials that include salt, sand, calcium chloride, magnesium chloride, and the like, such uncontrolled or uneven material spread causes damage to surrounding turf and/or landscaping, as well as causing inconsistent deicing.

As a result of these shortcomings associated with broadcast spreaders, drop spreaders were developed and are well known in the art. A drop spreader is similar in purpose to a broadcast spreader, but there are fundamental differences. In general, a drop spreader is a machine that distributes a calibrated amount of material from a hopper to the ground over approximately the width of the spreader. A rotor, which is a cylinder that rotates about a horizontal axis, is typically located in the bottom of the hopper to meter material out of an opening in the bottom of the hopper. The rate at which material is spread by a drop spreader, which is referred to as the drop rate of the spreader, is typically determined by the rotational speed of the rotor, the size of the bottom opening in the hopper, or both.

Due to the differences in construction and operation between a drop spreader and a broadcast spreader, a drop spreader typically includes a more precise rate of application of material, and a more controlled width of application of material, than a broadcast spreader.

A majority of the drop spreaders in the prior art are push or tow behind units that were designed for seeding or fertilizing applications. Because drop spreaders were originally designed for spreading fertilizers and seed, which are dry materials that flow relatively easily with gravity, only light agitation or vibration of the hopper was required. When drop spreaders were employed to spread salt or other deicing materials, which do not flow as easily, the use of gravity alone or light agitation frequently results in the stoppage of flow or "bridging" of material, to the point that the resulting spread rate is inconsistent or non-existent. For this reason, salt and other deicers may require substantially more agitation or vibration to assist in material flow.

As a result of this need for more agitation and vibration when dealing with salt and other deicing materials, drop spreaders in the prior art for winter services have been designed with specific features. More particularly, such drop spreaders typically employ a secondary agitator or a vibrator to assist in material flow for the spreading of salt and/or other deicing materials. The secondary agitator is used in addition to the primary rotor, and is a secondary rotational device that is placed above the rotor in the hopper. As the secondary agitator rotates, it essentially stirs the material, preventing it from bridging so that the material is consistently present at the rotor to provide a uniform flow. The vibrator is a vibratory device that is also used in addition to the primary rotor, and is mounted to the hopper. The vibrator operates at a high frequency to shake the hopper to facilitate uniform material flow, and can be hydraulically or electrically powered. The use of a secondary agitator or a vibrator undesirably increases the power demand of the drop spreader, undesirably adds components and cost to the drop spreader, undesirably increases the wear on the hopper, rotor, and other components, and in some cases, undesirably creates excessive noise.

For application of salt and/or other deicing material to confined areas such as sidewalks on a large scale, including school campuses and commercial institutions, drop spreaders are often mounted on small vehicles, such as ATVs, UTVs, and compact tractors. The drop spreaders typically are connected to the power source of the vehicle and are powered either by a power takeoff (PTO), hydraulics or electrically. A PTO involves transmitting engine power from the vehicle to the drop spreader using a drive shaft or a drive belt, hydraulic power involves a hydraulic hose connection between the vehicle and the drop spreader, and electric power involves a wire connection with a pin or plug connector. Prior art drop spreaders that employ a PTO or a hydraulic connection experience disadvantages having to do with their method of power, method of control for material drop rate, and method of connecting to the vehicle.

More particularly, in regard to their method of power, drop spreaders that are powered by a PTO or hydraulically are not compatible with many compact vehicles, as PTO or hydraulics typically require an agricultural-type tractor or a skid-steer vehicle. As for the method of control for material drop rate, drop spreaders that are powered by a PTO or hydraulically have a rotor speed that is directly proportional to engine speed. To change the drop rate, the size of the hopper opening must be adjusted. Such adjustments cannot be done from the operator seat unless a cable is used, which undesirably increases the cost and complexity of the spreader. In regard to the method of connecting to a vehicle, the PTO powered drop spreaders undesirably have the increased cost and complexity of a drive shaft, drive belt, or some other mechanical power transfer, with a corresponding PTO and clutch on the vehicle. Hydraulically powered spreaders include hydraulic hoses that connect to the vehicle with a hydraulic system and control valve on the vehicle, which are undesirably expensive to purchase and maintain.

Electrically-powered drop spreaders are typically easier to connect to the vehicle, to power, and to control, and are thus seen as being advantageous over PTO and hydraulically powered drop spreaders. However, prior art electrically powered drop spreaders include certain disadvantages.

For example, prior art drop spreaders that are powered electrically require a large amount of amperage to operate them. More particularly, the requirement of a secondary agitator or a vibrator, as described above, undesirably increases the power demand of the drop spreader. Because a small vehicle such as a tractor, lawnmower, or four-wheeler has a limited charge capability in a range between about 15 to 50 total amps, there may not sufficient power or charge capacity to power the spreader, the vehicle electrics, and lights.

In addition, prior art electric powered spreaders have a power cable that connects to the vehicle wiring system or battery. A power switch and/or variable speed controller must be present to control the spreader, and is typically located on the vehicle and connected to the spreader with a wire harness that must be installed on the vehicle. Such a connection undesirably increases the initial cost of the drop spreader, and also undesirably increases the cost to maintain the spreader, as the wires are susceptible to corrosion.

The disadvantages of the prior art make it desirable to develop an economical and reliable drop spreader that is electrically powered, removably mounted on a compact tractor, ATV, or UTV to enable a more convenient, more efficient method of spreading salt or other deicing material than a tow behind or push spreader, and provides a precise rate of material spreading, controlled width of material spread, uniform spread pattern, material savings, and labor savings. The sidewalk drop spreader for winter services of the present invention satisfies these needs, as will be described in detail below.

BRIEF SUMMARY OF THE INVENTION

An objective of the present invention is to provide a sidewalk drop spreader for winter services that is economical and reliable.

Another objective of the present invention is to provide a sidewalk drop spreader for winter services that is electrically powered.

Still another objective of the present invention is to provide a sidewalk drop spreader for winter services that is removably mountable on a compact tractor, ATV, or UTV.

Yet another objective of the present invention is to provide a sidewalk drop spreader for winter services that provides a precise rate of material spreading, controlled width of material spread, uniform spread pattern, material savings, and labor savings.

These objectives and others are obtained by the sidewalk drop spreader for winter services of the present invention. In an exemplary embodiment of the invention, the drop spreader includes a hopper. The hopper includes a pair of spaced-apart side walls, each one of which extends parallel to the other one of the side walls, a front wall extending between the side walls, and a rear wall extending between the side walls and being spaced apart from the front wall. An agitation system includes a motor that is mounted to the hopper, which actuates movement of at least a portion of a selected one of the side walls, front wall, and rear wall.

In another exemplary embodiment of the invention, the drop spreader includes a hopper. The hopper includes a pair of spaced-apart side walls, each one of which extends parallel to the other one of the side walls, a front wall extending between the side walls, and a rear wall extending between the side walls and being spaced apart from the front wall. The hopper also includes a bottom, which in turn includes a rotatable rotor and a compression roller that extend parallel to one another between the side walls. An agitation system is operatively connected to the hopper.

BRIEF DESCRIPTION OF THE SEVERAL VIEWS OF THE DRAWINGS

The preferred embodiment of the invention, illustrative of the best mode in which Applicant has contemplated applying the principles of the invention, is set forth in the following description and is shown in the drawings, and is particularly and distinctly pointed out and set forth in the appended claims.

Similar numerals refer to similar parts throughout the drawings.

DETAILED DESCRIPTION OF THE INVENTION

As described above, it has been more desirable to use a drop spreader rather than a broadcast spreader, because a drop spreader typically includes a more precise rate of application of material, and a more controlled width of application of material, than a broadcast spreader. However, prior art drop spreaders that employ a PTO or a hydraulic connection experience disadvantages having to do with their method of power, method of control for material drop rate, and method of connecting to the vehicle. Because electrically-powered drop spreaders are typically easier to connect to the vehicle, to power, and to control, they are thus seen as being advantageous over PTO and hydraulically powered drop spreaders. However, prior art electrically powered drop spreaders include certain disadvantages.

For example, drop spreaders that powered electrically require a large amount of amperage to operate them, which is attributable to the requirement of a secondary agitator or a vibrator, as described above. In addition, prior art electric powered drop spreaders employ wired connections that undesirably increase the initial cost of the drop spreader, and also undesirably increase the cost to maintain the spreader, as the wires are susceptible to corrosion.

The disadvantages of the prior art make it desirable to develop an economical and reliable drop spreader that is electrically-powered, removably mounted on a compact tractor, ATV, or UTV to enable a more convenient, more efficient method of spreading salt or other deicing material than a tow behind or push spreader, and provides a precise rate of material spreading, controlled width of material spread, uniform spread pattern, material savings, and labor savings. The sidewalk drop spreader for winter services of the present invention satisfies these needs, as will now be described.

Figure 1:
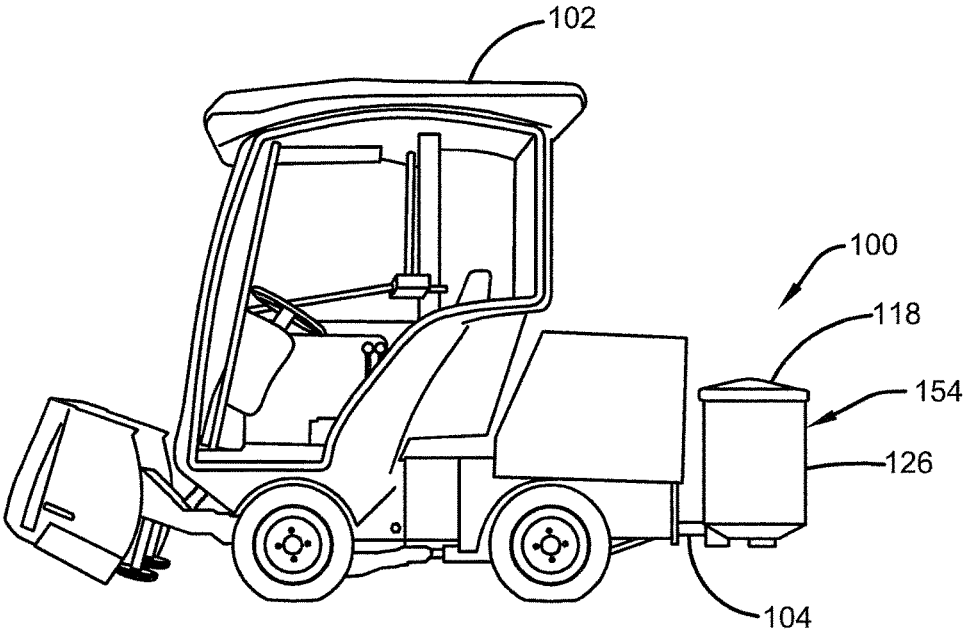
FIG. 1 is a side elevational view of a compact tractor with an exemplary embodiment of a sidewalk drop spreader for winter services of the present invention mounted thereon.
Figure 2:
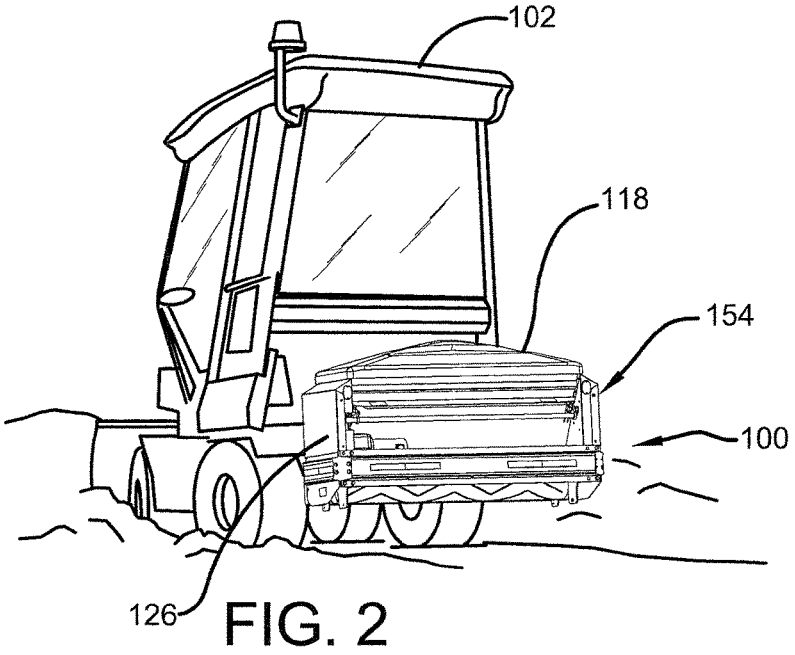
FIG. 2 is a rear perspective view of the compact tractor with sidewalk drop spreader shown in FIG. 1.
Figure 3:
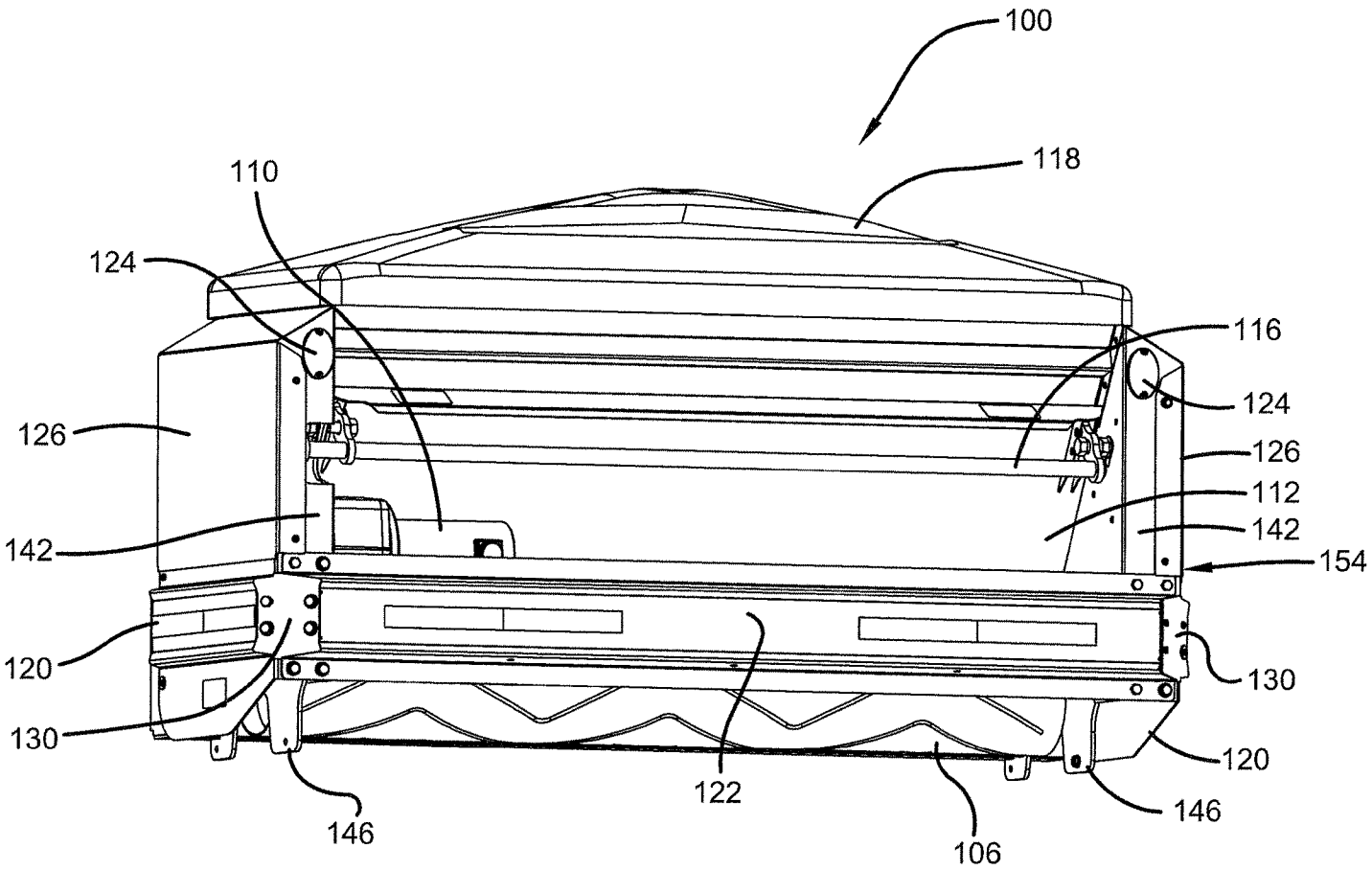
FIG. 3 is a rear perspective view of the exemplary embodiment of the sidewalk drop spreader for winter services of the present invention.
Figure 4:
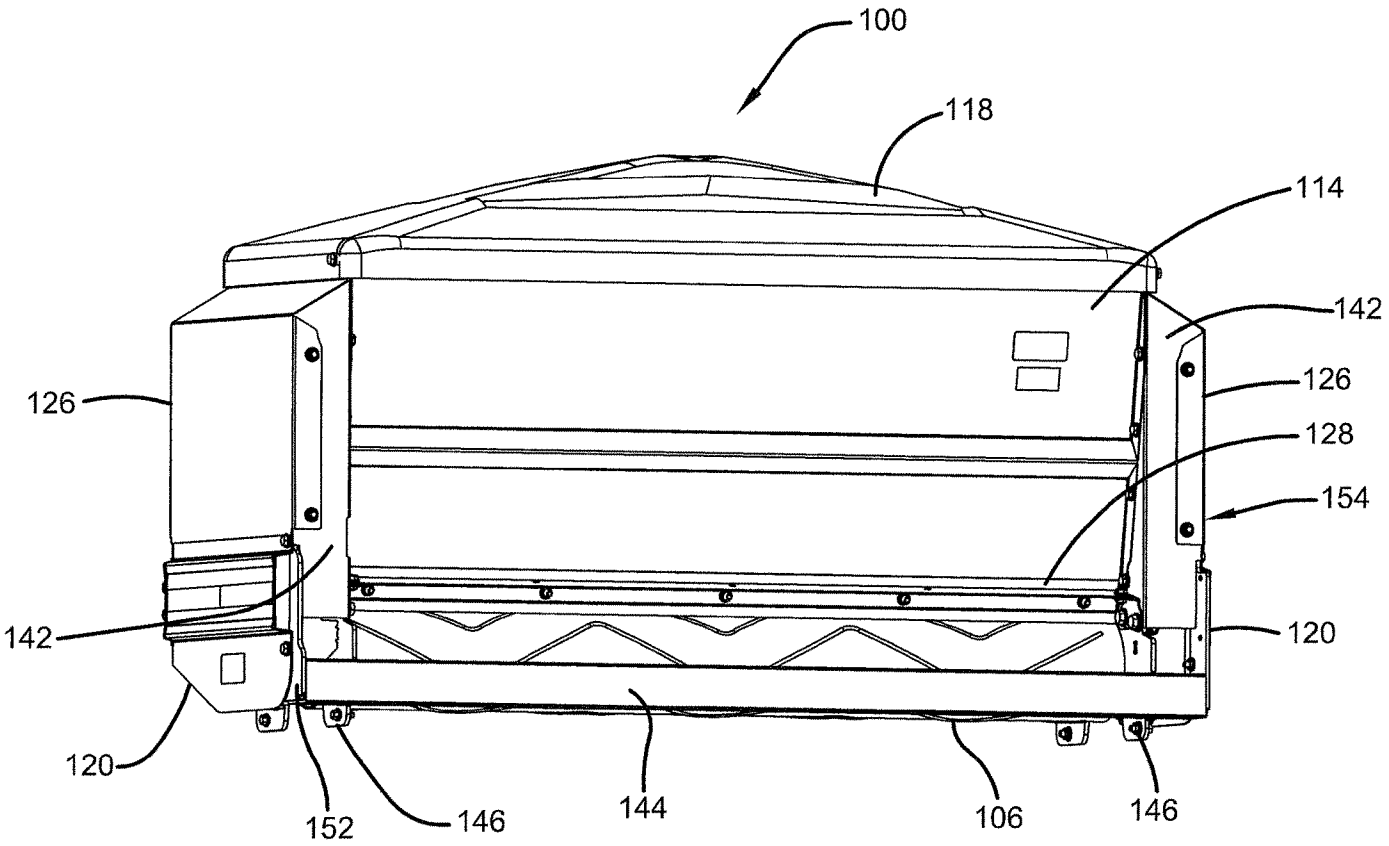
FIG. 4 is a front perspective view of the sidewalk drop spreader shown in FIG. 3.
Figure 5:
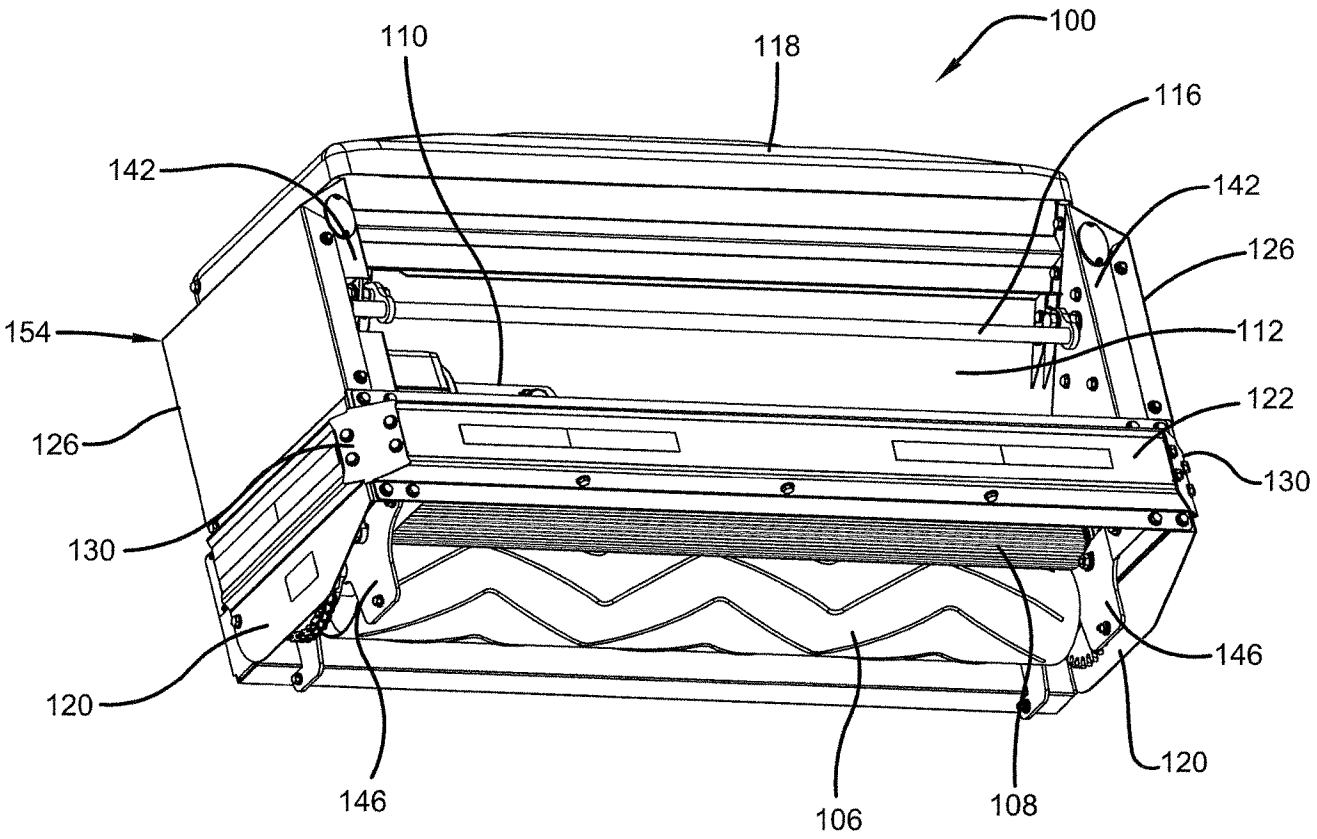
FIG. 5 is a bottom rear perspective view of the sidewalk drop spreader shown in FIG. 3.
Figure 6:
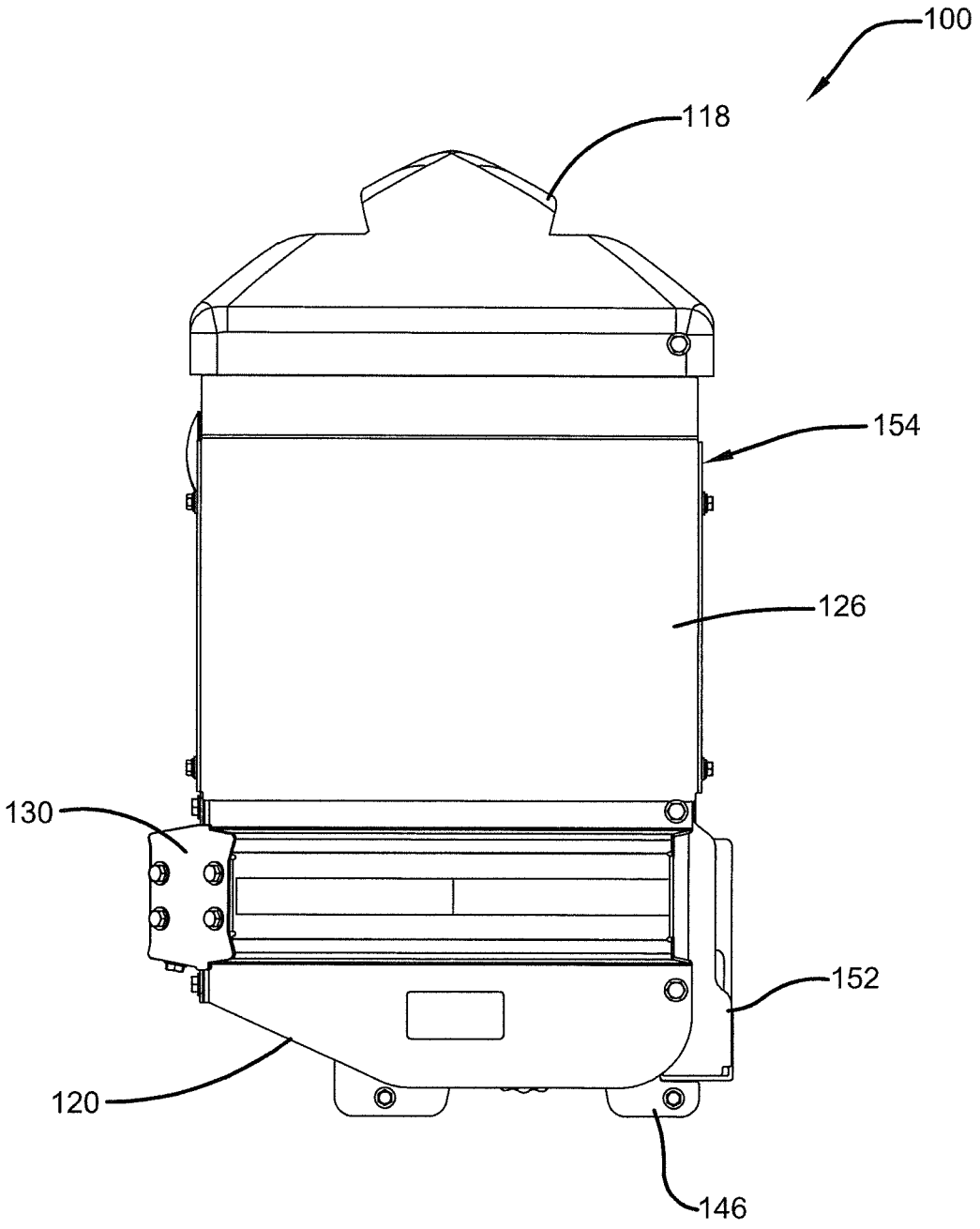
FIG. 6 is a side elevational view of the sidewalk drop spreader shown in FIG. 3.

Turning now to FIGS. 1-2, an exemplary embodiment of the sidewalk drop spreader for winter services of the present invention is indicated generally at 100. Sidewalk drop spreader 100 is mounted on a vehicle 102 such as an all-terrain vehicle (ATV), utility-terrain vehicle (UTV), or a compact tractor. Vehicle 102 is shown and described herein as a compact tractor by way of example. Preferably, sidewalk drop spreader 100 is removably mounted to compact tractor 102 by either a 2 inch receiver hitch or a category one three-point hitch 104.

Turning now to FIGS. 3-8 and 12, sidewalk drop spreader for winter services of the present invention 100 includes a hopper 154 with an agitation system that does not require a prior art internal auger, secondary agitator or vibrator. Hopper 154 of sidewalk drop spreader 100 includes a pair of spaced-apart side walls 142, each one of which extends parallel to the other one of the side walls, a front wall 114 that extends between said side walls and preferably is static, and a rear wall 112 that extends between the side walls and is spaced apart from the front wall. Side covers 126 are disposed on side walls 142, and a top cover 118 seats over the side walls, front wall 114, and rear wall 112. Hopper 154 preferably is formed of stainless steel, which prevents premature failure due to rust and corrosion.

Figure 7:
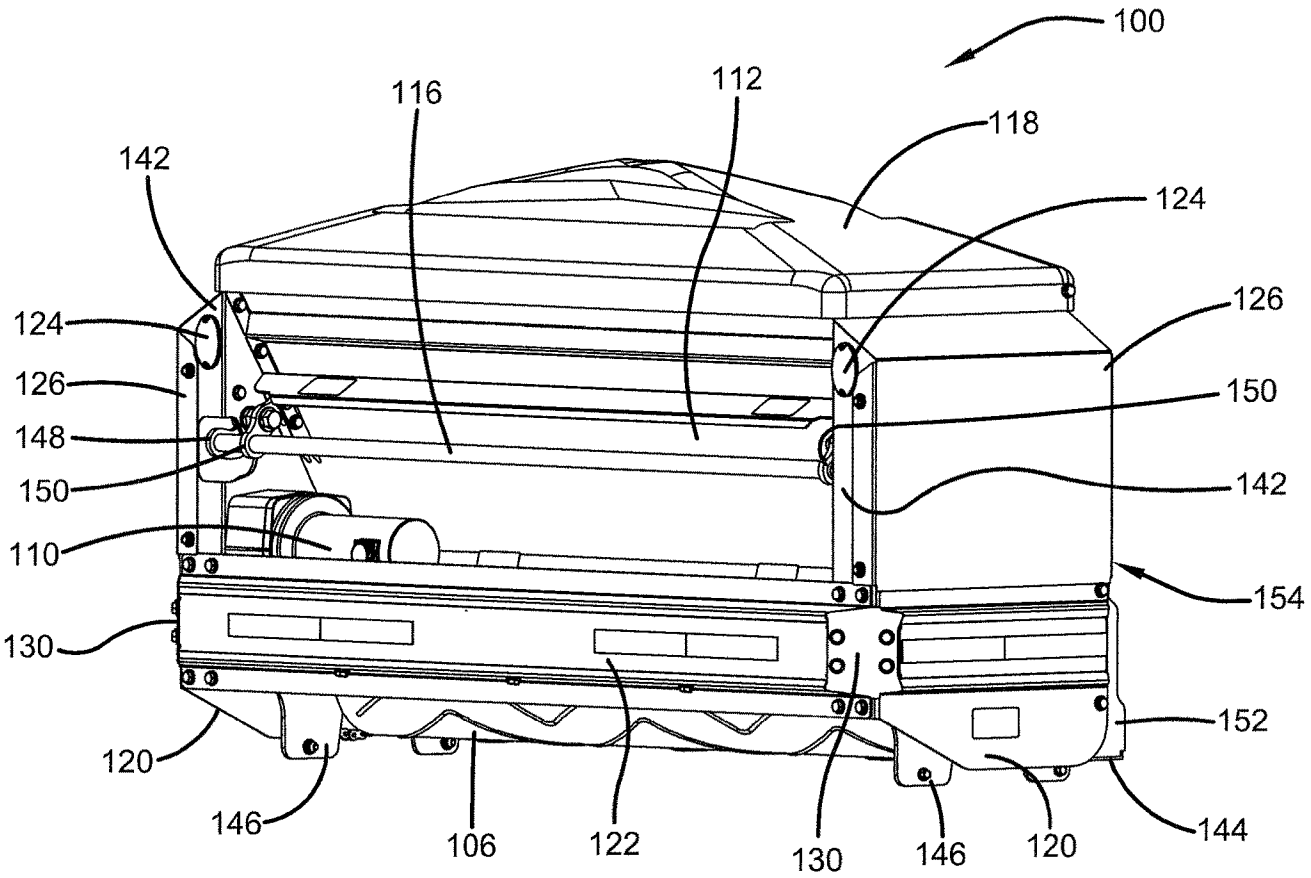
FIG. 7 is an additional rear perspective view of the sidewalk drop spreader shown in FIG. 3.
Figure 8:
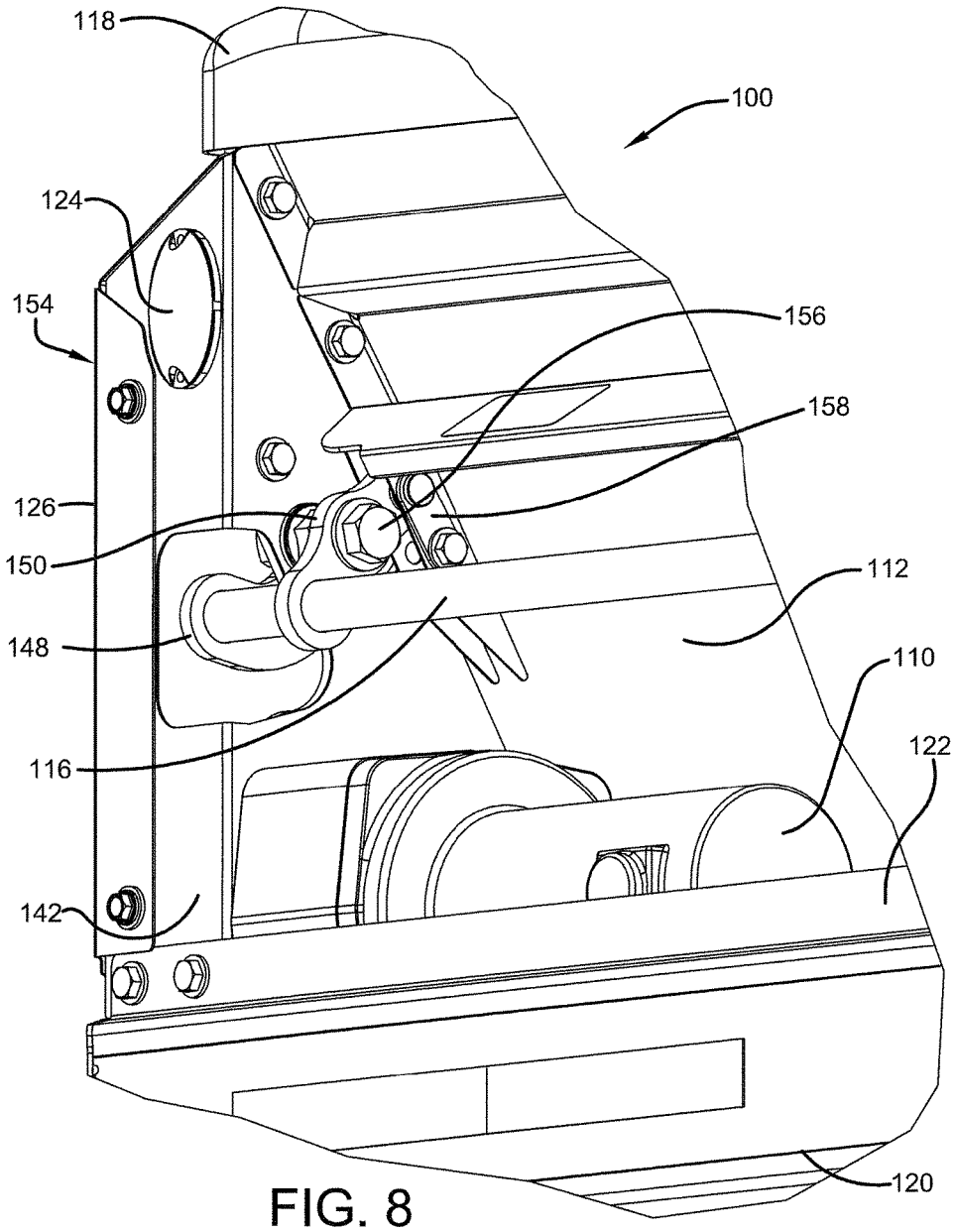
FIG. 8 is an enlarged fragmentary perspective view of a portion of the sidewalk drop spreader shown in FIG. 7.
Figure 9:
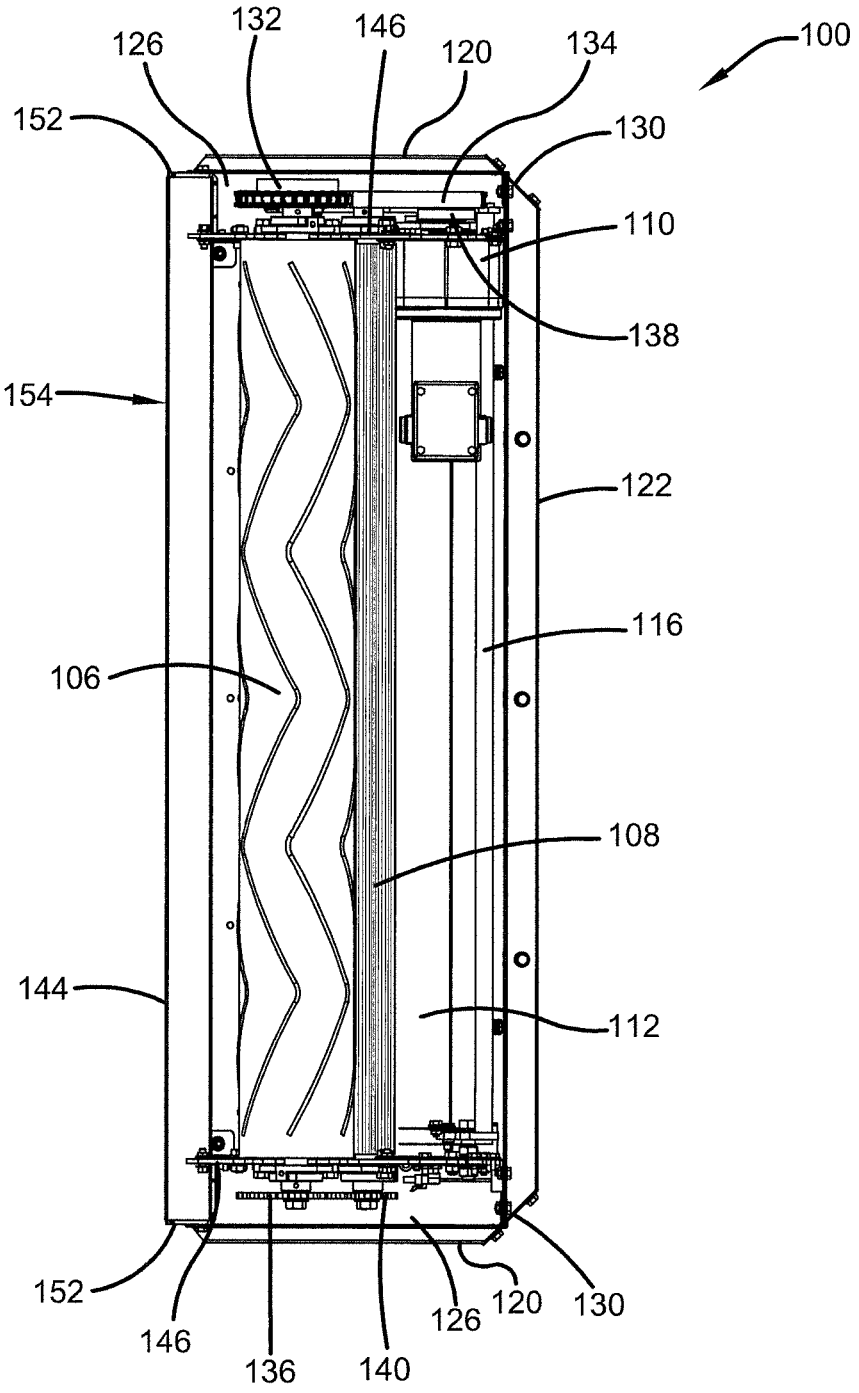
FIG. 9 is a bottom view of the sidewalk drop spreader shown in FIG. 3.
Figure 10:
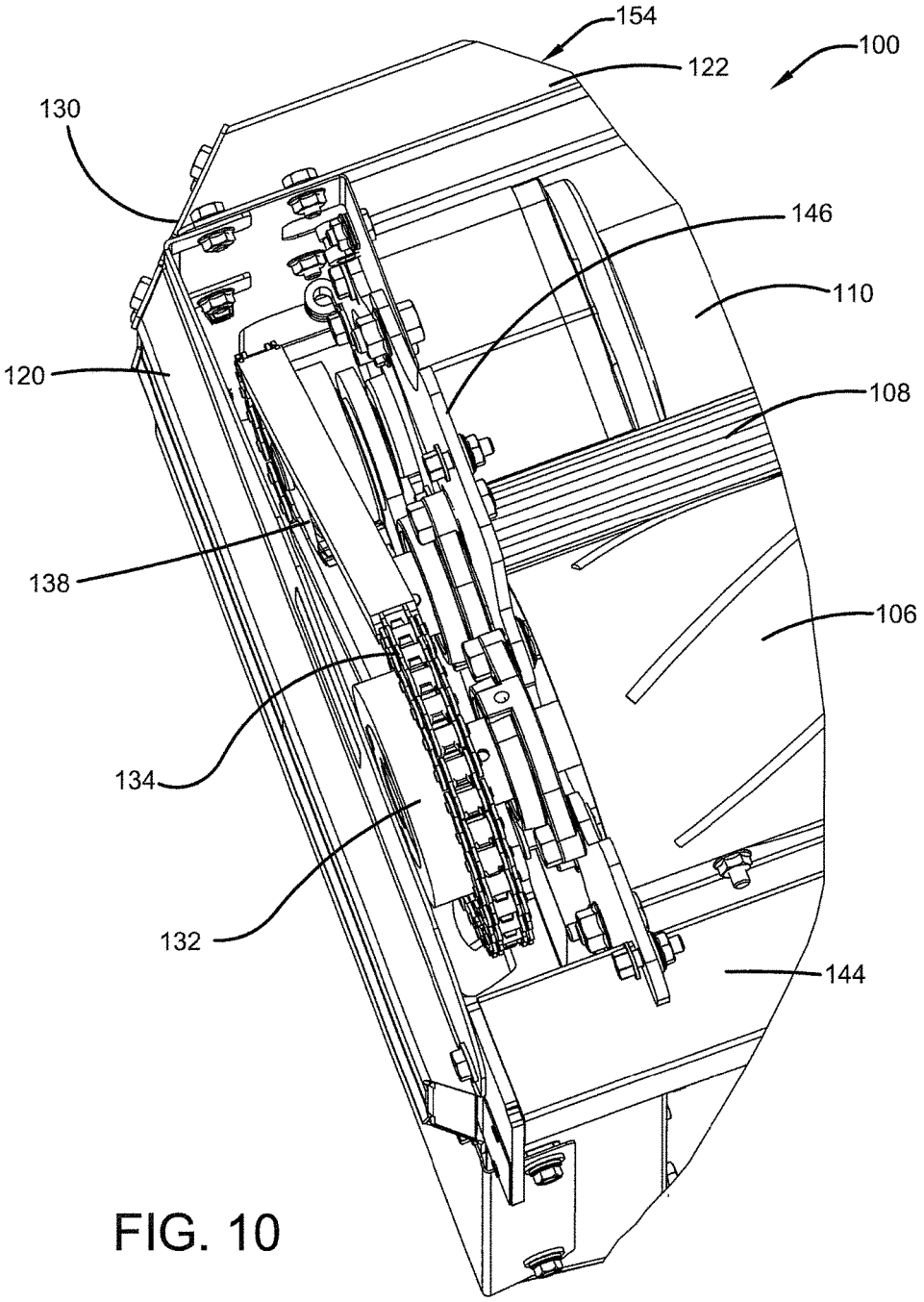
FIG. 10 is an enlarged fragmentary bottom view of a left side portion of the sidewalk drop spreader shown in FIG. 9.
Figure 11:
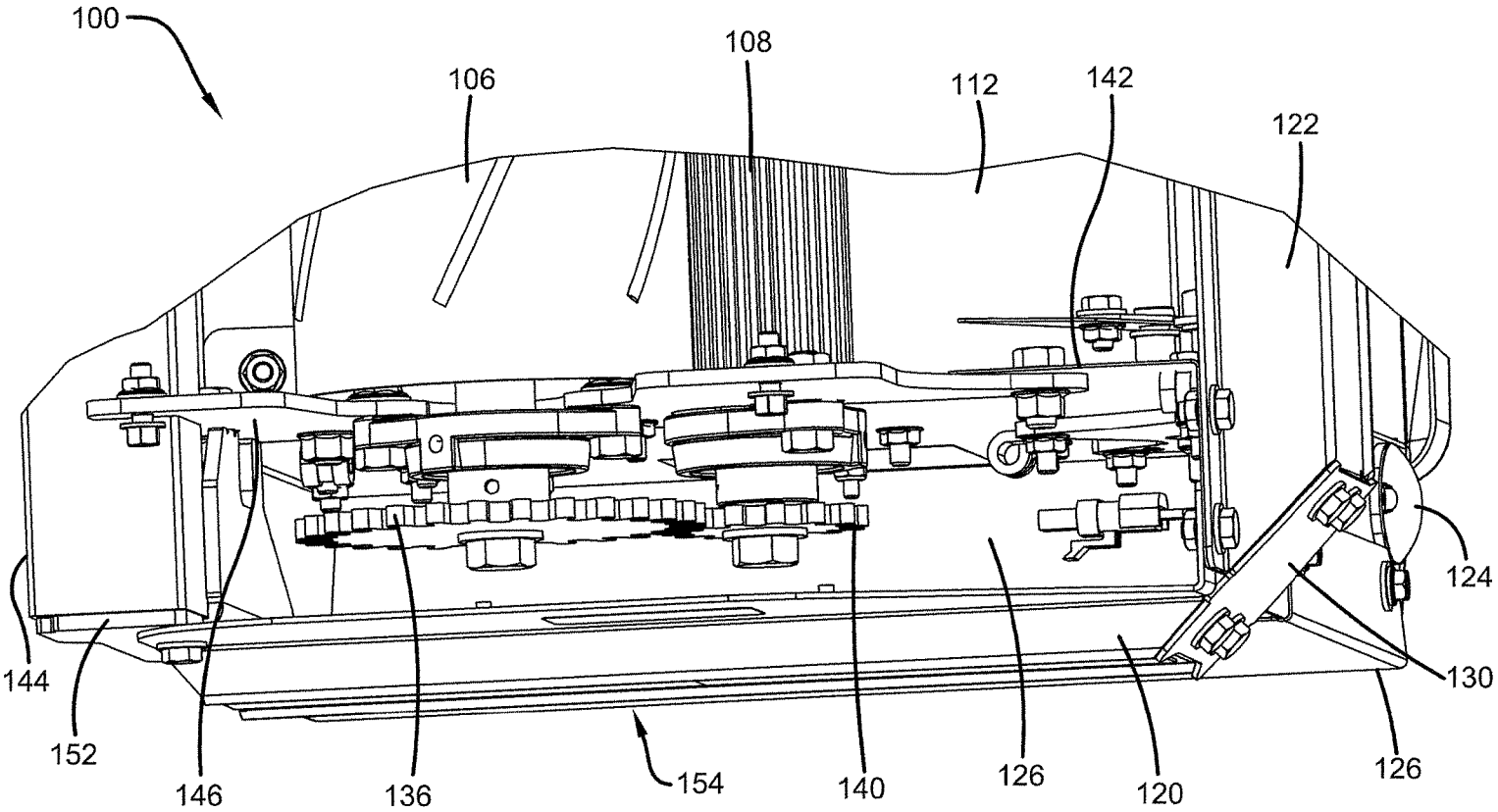
FIG. 11 is an enlarged fragmentary bottom view of a right side portion of the sidewalk drop spreader shown in FIG. 9.
Figure 12:
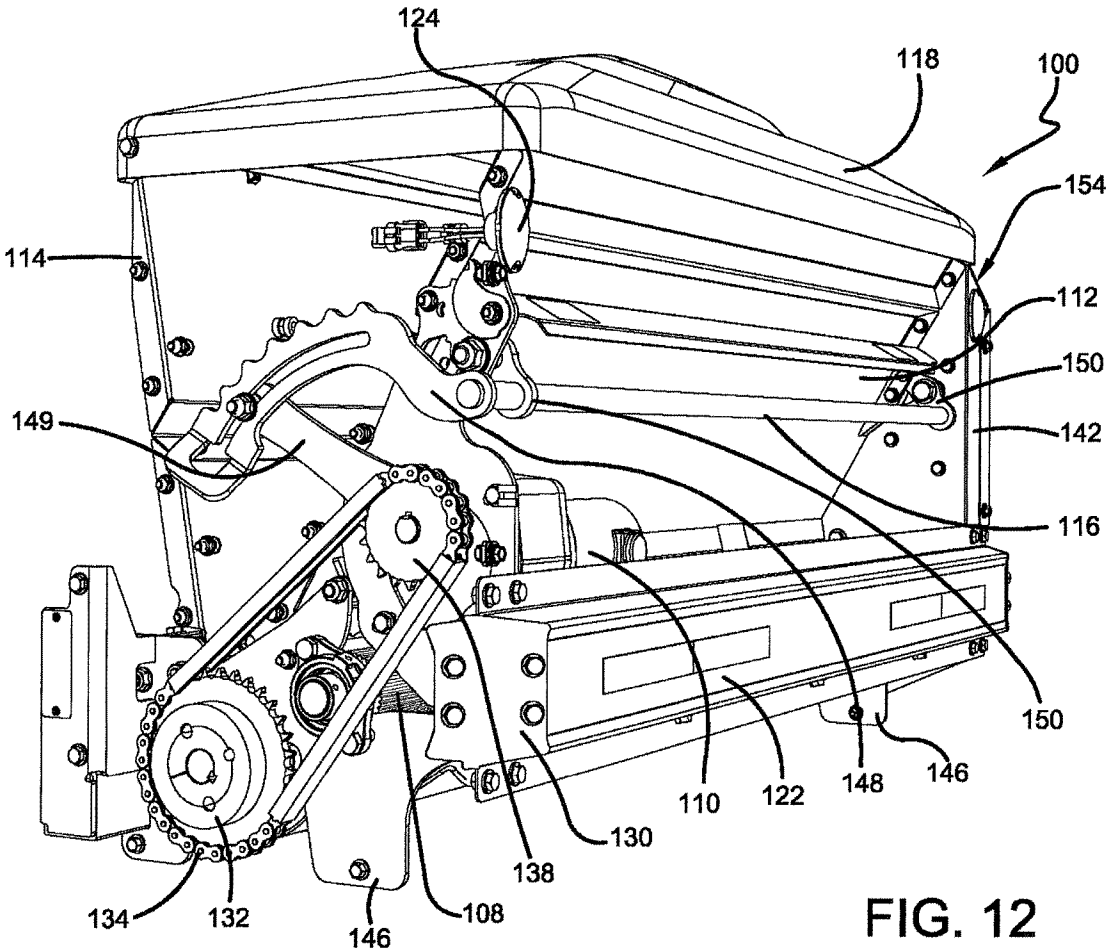
FIG. 12 is a bottom rear perspective view of a left side of the sidewalk drop spreader shown in FIG. 3 with the side cover and bottom bumper removed.

The agitation system includes moveable hopper wall 112, which is described herein as the rear hopper wall with the understanding that any hopper wall may constitute the moveable wall, and a moveable hopper wall control bar 116. Moveable hopper wall 112 is held in place by side walls 142 in a track, and angular front-to-rear movement of control bar 116 enables a back-and-forth linear movement of the moveable hopper wall. More particularly, as shown in FIGS. 7 and 8, control bar 116 is disposed through a control arm bracket 150. Control arm bracket 150 is connected to a wall bracket 158 by a pivot connection 156, such as a pin or bolt connection. Wall bracket 158 is in turn rigidly secured to an upper end of moveable hopper wall 112.

Each end of control bar 116 is secured to a respective side wall 142 of hopper 154. Connected to control bar 116 adjacent a selected one of side walls 142 that is proximate a motor 110, such as the left side wall, is an eccentric 148. Motor 110 preferably is a 12 volt direct current (DC) gear motor. Motor 110 preferably is rigidly attached to hopper left side wall 142, and a control arm 149 extends between and is connected to an output shaft of the motor and eccentric 148. During operation, the output shaft of motor 110 actuates control arm 149. Control arm 149 moves eccentric 148, which causes a slow rotation of control bar 116. As control bar 116 rotates, pivot connection 156 between control arm bracket 150 and wall bracket 158 enables moveable hopper wall 112 to move linearly back and forth. This movement is made in a linear manner at or near the top of hopper wall 112 due to the pivot connection of the moveable hopper wall to static side walls 142. The back-and-forth motion of hopper wall 112 agitates the material in the hopper to prevent the material from bridging, without the need for an internal auger, secondary agitator or vibrator.

Drop spreader 100 thus employs an innovative agitation system that uses simple components to convert power and rotational motion from motor 110 to a linear back-and-forth motion of wall 112, which results in a low maintenance system with highly reliable system life. By employing moveable hopper wall 112 that is connected to a single motor 110, drop spreader 100 of the invention reduces the power requirements of the spreader, as it is an integral hopper agitation, eliminating the need to drive a secondary agitator. In addition, because motor 110 preferably actuates slow back-and-forth movement of hopper wall 112, power requirements are reduced even further, and excessive noise and vibration is desirably reduced. The agitation of wall 112 can be powered by the same motor 110 as rotor 106, or optionally by a second motor. In addition, rather than entire selected hopper wall 112 being moveable, a portion of selected wall 112 may be moveable for agitation, while the remainder of the wall remains static.

Hopper 154 of drop spreader 100 also is covered, which desirably insulates salt or other deicing materials in the hopper from moisture that would cause the materials to agglomerate or bridge. Hopper is covered by hopper top cover 118, from the sides by static front wall 114, moveable rear wall 112, side walls 142, and side covers 126, and from the bottom in a manner that is described in greater detail below.

Turning now to FIGS. 5 and 9-11, the bottom of hopper 154 is sealed by a rotor 106 and a compression roller 108. Rotor 106 and compression roller 108 are rotatably connected to a bracket 146, which retains the position of the rotor and compression roller. More particularly, bracket 146 is bolted to side wall 142 and a front bottom bar 144 of hopper 154. Side wall 142 is bolted to a side bottom bumper 120 of hopper 154, hopper side covers 126, and also to a rear bottom bumper 122. Side bottom bumper 120 and rear bottom bumper 122 are connected to one another by an interconnecting plate 130. A front internal plate 152 is connected to side bottom bumper 120 and front bottom bar 144.

Rotor 106 and compression roller 108 extend parallel to one another and are mechanically coupled together by a driving rotor gear 136 and a gear 140 for the compression roller. Compression roller 108 preferably includes a pliable material on its outer diameter so that it may abut rotor 106 in sealing contact without binding. In this manner, rotor 106 and compression roller 108 seat against one another and rotate in a cooperative manner to meter and thus provide a uniform flow of deicing material out of drop spreader 100.

The rate of metering of drop spreader 100 is enabled by rotor 106, which is driven by motor 110. More particularly, rotor 106 is operatively connected to a rotor sprocket 132. Motor 110 is operatively connected to a drive sprocket 138, as the drive sprocket typically is mounted on an output shaft of the motor. A chain 134 or other connecting means, such as a belt, interconnects drive sprocket 138 and rotor sprocket 132. When motor 110 is actuated, its output shaft causes drive sprocket 138 to rotate, which moves chain 134 and drives rotor sprocket 132, thereby causing rotor 106 to rotate. Because rotor 106 and compression roller 108 are mechanically coupled by rotor gear 136 and compression roller gear 140, the compression roller rotates cooperatively with the rotor. The close proximity and contact of rotor 106 and compression roller thus seals the outlet of hopper 154 and prevents leakage or trickling of material when drop spreader 100 is not in use.

As described above, rotor 106 forms the bottom wall of sidewalk drop spreader 100. The bottom edge of rear hopper wall 112 abuts the outer diameter of rotor 106 to form the gate for hopper 154. To seal the connection between front hopper wall 114 and rotor 106, a wiper bar 128 (FIG. 4) extends between hopper side walls 142 and from the front hopper wall to the rotor. A front bottom bar 144 extends through rotor and compression roller bracket 146 and attaches to front internal plate 152, which is in turn attached to side bottom bumper 120.

Motor 110 preferably is a variable-speed motor, which enables rotor 106 to rotate at different speeds as selected by the vehicle operator. Preferably, a large gear reduction ratio is employed, which enables motor 110 to be small, with low amperage requirements. In addition, motor 110 preferably is a heavy weatherproof motor, and drop spreader 100 preferably includes a sealed electrical system, thereby enabling the spreader to withstand harsh winter conditions for extended periods of time.

Motor 110 preferably is actuated and operated by a wireless control system, which enables the operator to control the rate of material dispersion by drop spreader 100 from the vehicle seat, without the need for a wiring harness. Preferably, the wireless control system only requires a two-wire connection, battery supply, and ground. Since the controls are wireless, any vehicle with power supply at the hitch, such as a standard seven-pin trailer connector or custom connection, is equipped to operate drop spreader 100. Such a wireless remote control preferably regulates multiple motor speeds for quick flow adjustments from the operator seat.

As an optional feature, drop spreader 100 preferably includes a light 124. Light 124 is mounted on an internal surface of side wall 142 of hopper 154.

With this construction, drop spreader 100 provides a hopper 154 that enables uniform metering and spreading of deicing materials, while insulating the materials in the hopper from moisture that would cause them to agglomerate or bridge. Hopper 154 also prevents leakage or trickling of material when not in use, since compression roller 108 is mechanically coupled to rotor 106, which prevents material from passing between the rotor and the compression roller when the rotor is not activated to release material. Since compression roller 108, which acts as a cylindrical seal, does not normally require adjustment by the operator, there are no cables or linkages to corrode.

By way of example, sidewalk drop spreader for winter services of the present invention 100 includes a length of about 22 inches, a width of about 47 inches, a drop width of about 40 inches, a height of about 16 inches, and a weight of about 160 pounds. Preferably, drop spreader 100 has a material capacity of about 2.5 cubic feet or 200 pounds. In addition, drop spreader 100 optionally includes a high-capacity extension that extends the total material capacity up to about 5.0 cubic feet or 400 pounds. Such a narrow frame design and 40 inch drop pattern enables optimum use of drop spreader 100 for spreading deicing and/or traction material on sidewalks and other narrow walkways. Material disbursement can be fine-tuned with simple adjustments, allowing operators to travel up to 3 miles on one fill of hopper 154 at a typical application rate, such as applying bagged rock salt at 3.5 pounds per one thousand square feet at 5 miles per hour.

Preferably, drop spreader 100 includes universal mounting features, which enables it to be mounted to a vehicle using a 2 inch receiver hitch or a category one three-point hitch, thereby enabling easy connection to a variety of equipment in and can be switched from machine to machine in a matter of minutes. When drop spreader 100 is used with a preferred compatible tractor and attachment, such as a tractor with a snow plow on its front end and the drop spreader on its rear end, the system enables a user to provide efficient single-pass snow removal and deicing.

In this manner, sidewalk drop spreader for winter services of the present invention 100 provides an economical and reliable drop spreader that is electrically-powered, removably mounted on a compact tractor, ATV, or UTV to enable a more convenient, more efficient method of spreading salt or other deicing material than a tow behind or push spreader, and provides a precise rate of material spreading, controlled width of material spread, uniform spread pattern, material savings, and labor savings.

Sidewalk drop spreader for winter services 100 is used for the spreading of an array of deicing materials with precision flow control. Drop spreader 100 has the ability to spread materials such as bulk salt and sand, as well as free flowing material such as pelletized material and calcium flakes. Sidewalk drop spreader 100 preferably includes a 12 volt direct current gear motor 110 that powers rotor 106. The use of electric motor 110 enables sidewalk drop spreader 100 to be attached to and used on nearly any compact vehicle.

Sidewalk drop spreader 100 utilizes a highly effective agitation system by moveable wall 112 through a connection to motor 110. This agitation system has a low power requirement, generates little to no noise, and is made up of simple components, thereby resulting in low maintenance and a highly reliable system life.

Sidewalk drop spreader 100 employs hopper 154 that prevents leakage or trickling of material when not in use. Hopper 154 includes compression roller 108, which is in constant contact with the rotor 106. Rotor 106 forms the bottom wall of hopper 154 and thus sidewalk drop spreader 100.

Moreover, sidewalk drop spreader 100 has a wireless control system, which reduces the number of wires connecting the electrically powered spreader to the vehicle and allows the use of a controller to adjust the rotational speed of motor 110 for rotor 106. The use of a hand-held transmitter with this wireless control system enables indicators on the transmitter to provide a convenient visual indicator of the rotor speed.

The present invention also includes a method for spreading an array of deicing materials using a sidewalk drop spreader for winter services. The method includes steps in accordance with the description that is presented above and shown in FIGS. 1-11.

It is to be understood that the structure of the above-described sidewalk drop spreader for winter services of the present invention may be altered or rearranged, or certain components omitted or added, without affecting the overall concept or operation of the invention. It is to be further understood that the sidewalk drop spreader for winter services of the present invention may be employed with any deicing materials known in the art, including salt, sand, calcium chloride, magnesium chloride, and the like, and any form thereof, including particulate, pelletized, and flakes, without affecting the overall concept or operation of the invention.

Accordingly, the sidewalk drop spreader for winter services of the present invention is simplified, provides an effective, safe, inexpensive, and efficient structure which achieves all the enumerated objectives, provides for eliminating difficulties encountered with prior art sidewalk drop spreaders, and solves problems and obtains new results in the art.

In the foregoing description, certain terms have been used for brevity, clarity and understanding; but no unnecessary limitations are to be implied therefrom beyond the requirements of the prior art, because such terms are used for descriptive purposes and are intended to be broadly construed. Moreover, the present invention has been described with reference to an exemplary embodiment. It shall be understood that this illustration is by way of example and not by way of limitation, as the scope of the invention is not limited to the exact details shown or described. Potential modifications and alterations will occur to others upon a reading and understanding of this disclosure, and it is understood that the invention includes all such modifications and alterations and equivalents thereof.

Having now described the features, discoveries and principles of the invention, the manner in which the sidewalk drop spreader for winter services of the present invention is constructed, arranged and used, the characteristics of the construction and arrangement, and the advantageous, new and useful results obtained; the new and useful structures, devices, elements, arrangements, parts and combinations are set forth in the appended claims.

What is claimed is:

1. A sidewalk drop spreader for winter services, said drop spreader comprising:

a hopper, said hopper including:

a pair of spaced-apart side walls, each one of said side walls extending parallel to the other one of the side walls;

a front wall connected with said side walls; and a rear wall connected with said side walls and being spaced apart from said front wall; and an agitation system, said agitation system including a motor being mounted to said hopper and actuating movement of an entire selected one of said side walls, front wall, or rear wall.

2. The sidewalk drop spreader for winter services of claim 1, wherein said motor actuates linear motion of said selected wall.

3. The sidewalk drop spreader for winter services of claim 2, wherein said agitation system includes a control bar that is operatively connected to said selected wall and to said motor.

4. The sidewalk drop spreader for winter services of claim 1, wherein said motor is a twelve volt direct current gear motor.

5. The sidewalk drop spreader for winter services of claim 1, wherein said motor is actuated and operated by a wireless control system.

6. The sidewalk drop spreader for winter services of claim 1, wherein said selected wall is said rear wall.

7. The sidewalk drop spreader for winter services of claim 1, wherein said hopper further includes a top cover disposed on said side walls, front wall, and rear wall.

8. The sidewalk drop spreader for winter services of claim 1, wherein said hopper further includes side covers disposed on said side walls.

9. The sidewalk drop spreader for winter services of claim 1, wherein said hopper walls are formed of stainless steel.

10. The sidewalk drop spreader for winter services of claim 1, wherein said sidewalk drop spreader further comprises a light mounted on said hopper.

11. The sidewalk drop spreader for winter services of claim 1, wherein said sidewalk drop spreader is removably mountable on at least one of an all-terrain vehicle, utility-terrain vehicle, and a compact tractor.

12. The sidewalk drop spreader for winter services of claim 1, wherein said sidewalk drop spreader is removably mountable by at least one of a two-inch receiver hitch and a category one three-point hitch.

13. The sidewalk drop spreader for winter services of claim 1, wherein said sidewalk drop spreader includes a material capacity of about two and one-half to about five cubic feet.

14. The sidewalk drop spreader for winter services of claim 1, wherein said sidewalk drop spreader includes a material capacity of about two hundred to about four hundred pounds.

15. The sidewalk drop spreader for winter services of claim 1, wherein said motor actuates back-and-forth linear movement of said rear wall relative to said front wall.

16. A sidewalk drop spreader for winter services, said drop spreader comprising:

a hopper, said hopper including:

a pair of spaced-apart side walls, each one of said side walls extending parallel to the other one of the side walls;

a front wall extending between said side walls;

a rear wall extending between said side walls and being spaced apart from said front wall; and a bottom, said bottom including a rotatable rotor and a compression roller, said rotor and said compression roller extending parallel to one another between said side walls; and an agitation system operatively connected to said hopper.

17. A sidewalk drop spreader for winter services, said drop spreader comprising:

a hopper, said hopper including:

a pair of spaced-apart side walls, each one of said side walls extending parallel to the other one of the side walls;

a front wall extending between said side walls;

a rear wall extending between said side walls and being spaced apart from said front wall; and a bottom, said bottom including a rotor and a compression roller, said rotor and said compression roller extending parallel to one another between said side walls; and an agitation system, said agitation system including a motor mounted to said hopper and actuating movement of at least a portion of a selected one of said side walls, front wall, and rear wall.

18. The sidewalk drop spreader for winter services of claim 17, wherein said rotor is operatively connected to said motor, and the motor actuates rotation of the rotor.

19. The sidewalk drop spreader for winter services of claim 18, wherein said rotor and said compression roller are operatively coupled to one another, so that rotation of the rotor actuates cooperative rotation of the compression roller.

20. The sidewalk drop spreader for winter services of claim 19, wherein said compression roller includes a pliable material on its outer diameter.

* * * * *